US005513544A

United States Patent [19]

Winkler et al.

[11] Patent Number: 5,513,544

[45] Date of Patent: May 7, 1996

[54] LOCKING, RETRACTING MECHANISM FOR CRANK HANDLES

[75] Inventors: John Winkler; John M. Winkler, both of New Berlin, Wis.

[73] Assignee: J. W. Winco, Inc., New Berlin, Wis.

[21] Appl. No.: 271,188

[22] Filed: Jul. 7, 1994

[51] Int. Cl.[6] ..... G05G 1/00

[52] U.S. Cl. ..... 74/547; 74/548; 74/543; 74/545; 81/177.8; 81/177.9

[58] Field of Search ..... 16/11 OR, 110.5, 16/111 R; 81/177.8, 177.9, 177.2, 177.7; 74/543–548, 557

[56] References Cited

U.S. PATENT DOCUMENTS

| | | | |
|---|---|---|---|
| 2,556,995 | 6/1951 | Coffing | 81/177.9 |
| 3,603,171 | 9/1971 | Dodge | 74/548 |
| 4,334,445 | 6/1982 | Timewell | 81/177.8 |
| 4,674,355 | 6/1987 | Klein | 74/543 |
| 4,700,033 | 10/1987 | Clark | 74/548 X |
| 4,711,145 | 12/1987 | Inoue | 81/177.8 |
| 4,787,276 | 11/1988 | Condon | 81/177.8 |
| 4,794,829 | 1/1989 | Mesenhoeller | 81/177.8 |
| 5,150,853 | 9/1992 | Bernard et al. | 74/545 X |
| 5,188,189 | 2/1993 | Hummel | 81/177.8 X |
| 5,280,738 | 1/1994 | Liou | 81/177.9 X |

FOREIGN PATENT DOCUMENTS

| | | | |
|---|---|---|---|
| 141461 | 6/1951 | Australia | 81/177.7 |
| 390570 | 1/1941 | Germany | 74/545 |
| 1051160 | 2/1959 | Germany | 74/548 |
| 2218614 | 10/1973 | Germany | 74/545 |

*Primary Examiner*—Vinh T. Luong
*Attorney, Agent, or Firm*—Whyte Hirschboeck Dudek

[57] ABSTRACT

A retractable, locking mechanism for use with a crank handle wherein the mechanism allows the handle to be rotated from an extended position to a retracted position is comprised of a male swivel and a female swivel, a pin for joining the male and female swivels and a spring for urging the male swivel to seat with the female swivel. The pin is fixed between flanges extending from the female swivel. The male swivel extends between the flanges and rotates about the pin which extends through a cavity defined within the male swivel. When the male swivel is in an "extended" position, the male swivel is engaged with the female swivel such that their axes are aligned and an axially extending shaft on the male swivel seats in an axially extending bore in the female swivel. The spring rides in the cavity of the male swivel and is biased against the pin such that the spring urges the shaft of the male swivel into the bore of the female swivel. When the male swivel is rotated to a "retracted" position, the spring urges the male swivel against the flanges of the female swivel such that the axis of the male swivel is perpendicular to the axis of the female swivel. When the shaft mechanism is utilized as the shaft on a crank, the crank handle can be adjusted from a position which allow use of the handle to apply a moment about the shaft to a position in which the handle is less protrusive.

4 Claims, 2 Drawing Sheets

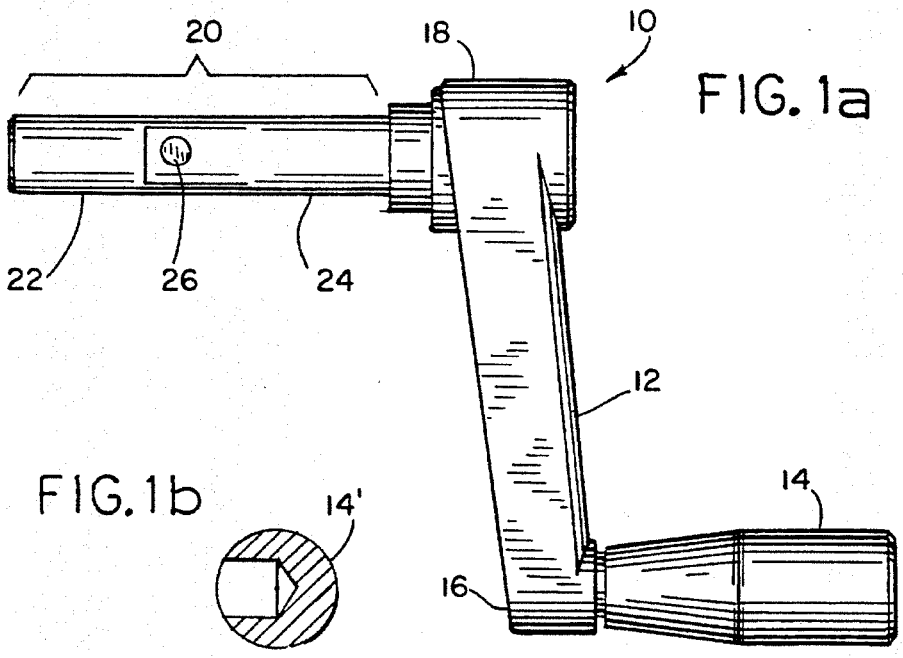
FIG. 1a
FIG. 1b
FIG. 2
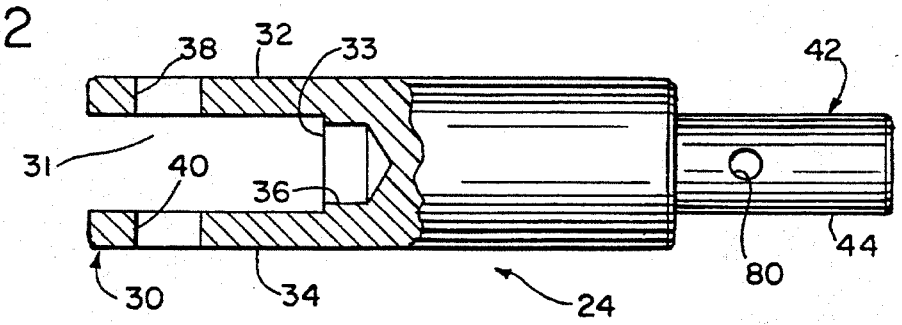
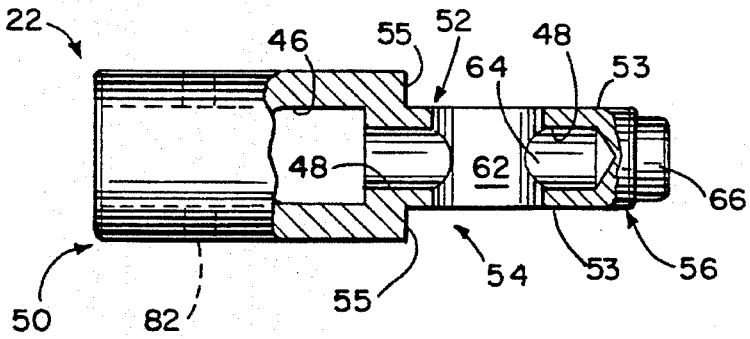
FIG. 3a
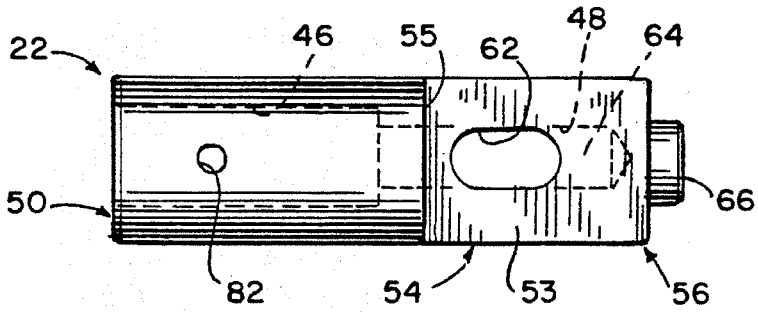
FIG. 3b

LOCKING, RETRACTING MECHANISM FOR CRANK HANDLES

CROSS-REFERENCES TO RELATED APPLICATIONS, IF ANY

None.

Statement as to rights to inventions made under federally-sponsored research and development, if any None.

BACKGROUND OF THE INVENTION

1. Field of the Invention

This invention relates generally to the field of crank handles, and more specifically, to a retractable crank handle having a mechanism for aligning and locking the handle along the axis of rotation.

2. Description of the Prior Art

Crank handles are well known in the art. These handles may be employed to increased the torque applied to an axis of rotation and can be found on a variety of equipment. For example, such handles may be used to adjust the position of a work surface on fabricating equipment, to raise and lower retractable wheels on a trailer, or to rotate a take-up barrel on winching equipment. These handles generally are comprised of an arm, a handle attached to one end of the arm and a shaft attached to the other end of the arm. The shaft is aligned with the axis of rotation such that as a force is applied to the handle of the crank, a torque is applied about the rotational axis. The torque applied about the axis of rotation is, in part, a function of the length of the arm.

Various improvements have been made to the components of these crank handles. One such improvement is to place at least one hinged joint along the body of the crank handle so that at least a portion of the crank handle can be retracted. Specifically, this retractable portion rotates about the hinge such that the crank handle is less likely to protrude. This type of retractable crank handle is especially useful in instances where the protruding handle could be dangerous or interfere with the operation of the equipment to which the handle is attached. For example, after a crank handle has been used to adjust the height of a work surface on fabricating equipment, use of the equipment may be impeded by the protruding handle. By providing a hinged joint along the crank handle, at least a portion of the handle can be rotated to a position less likely to interfere with operation of the equipment. Those skilled in the art will understand that it is more desirable to locate the hinged joint along the shaft rather than the arm because this allows retraction of a greater portion of the handle.

Use of a hinge has presented various other difficulties and necessitated improvements to retractable crank handles. For example, retractable crank handles can be difficult to operate because alignment between the hinged portions may be difficult to maintain during rotation of the handle. Failure to keep hinged portions properly aligned renders the crank handle awkward to operate and may damage the handle by placing unintended forces on the hinge itself. Furthermore, when the handle is in its retracted position, there will be a tendency for the retracted portion of the handle to swing freely at the hinge, presenting difficulties such as those mentioned in the preceding paragraph. Thus the full benefit of the ability of the handle to be retracted is not realized. One solution to this problem has been to provide a pin or a ball and socket which are used to hold hinged portions in proper alignment. These solutions can also be employed to hold the retractable portion in its fully retracted position when the handle is not in use. However, one drawback to the solution utilizing a pin is that the pin must be inserted externally, thus complicating use of the crank handle. Additionally, the pin may not support the forces transferred through the handle. A drawback to the ball and socket is that the forces transferred at the joint between portions of the crank handle may be sufficient to urge the ball out of the socket causing the portions of the handle to become unaligned.

One solution to the problem with the ball and socket has been to provide a sleeve which is slidably mounted on the shaft or arm comprised of the hinged portions. The sleeve is designed so that it can be moved to a position along the shaft or arm so as not to interfere with the motion of the hinge when the shaft or arm is bent. However, when positioned adjacent the hinge, the sleeve prevents the hinge from pivoting and provides support between hinged portions, thus maintains alignment between the portions. Again, however, the sleeve is attached external to the handle and must be moved into position once the hinged portions of the crank handle are properly aligned.

Therefore, it would be desirable to provide a retractable crank handle that has an internal means for maintaining alignment. This means should allow a transfer of force between hinged portions without degradation of the force or damage to the crank handle. Additionally, it would also be desirable if the retractable crank handle can rotate or swing through approximately 180 to allow the retractable portion of the handle to be retracted in the least protrusive position. Lastly, such a handle should maintain a retracted position without the need for external fasteners to prevent the handle from swinging into an equilibrium position.

SUMMARY OF THE INVENTION

The present invention provides a retractable, locking mechanism for use a crank handle wherein the mechanism allows the handle to be rotated from an extended position to a retracted position. The shaft mechanism is comprised of a male swivel and a female swivel, a pin for joining the male and female swivels and a spring for urging the male swivel to seat with the female swivel. The pin is fixed between flanges extending from the female swivel. The male swivel extends between the flanges and rotates about the pin which extends through a cavity defined within the male swivel. When the male swivel is in an "extended" position, the male swivel is engaged with the female swivel such that their axes are aligned and an axially extending shaft on the male swivel seats in an axially extending bore in the female swivel. The spring rides in the cavity of the male swivel and is biased against the pin such that the spring urges the shaft of the male swivel into the bore of the female swivel. When the male swivel is rotated to a "retracted" position, the spring urges the male swivel against the flanges of the female swivel such that the axis of the male swivel is substantially perpendicular to the axis of the female swivel. In one embodiment, the shaft mechanism is utilized as the shaft on a crank handle. The crank handle is comprised of an arm, the shaft mechanism attached to a first end of the arm and a handle attached to the second end of the arm. When the shaft mechanism is utilized as the shaft on a crank handle, the crank handle can be adjusted from a first position at which the handle can be used to apply a moment about the shaft to a second position at which the handle is less protrusive and less likely to interfere with movement around the handle.

BRIEF DESCRIPTION OF THE DRAWINGS

In the drawings which illustrate that which is presently regarded as the best modes for carrying out the invention:

FIG. 1 illustrates a side view of the assembled locking, retractable crank handle.

FIG. 2 is a side view of the female swivel.

FIG. 3*a* is a side view of the male swivel.

FIG. 3*b* is a top view of the male swivel.

DESCRIPTION OF THE PREFERRED EMBODIMENTS

Figure 4:
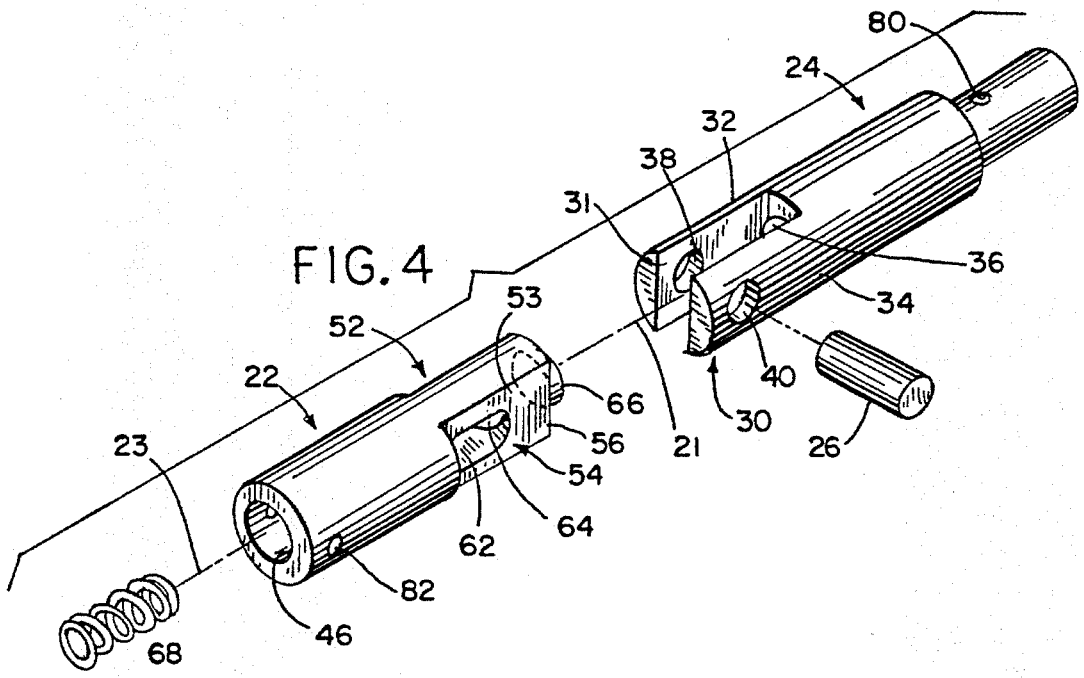
FIG. 4 is an exploded pictorial of the male and female swivels.

In FIG. 1, a locking, retracting crank handle is illustrated and generally designated as 10. Crank handle 10 comprises an arm 12, a handle 14 attached to a first end 16 of arm 12 and a shaft mechanism 20 attached to a second end 18 of arm 12. Shaft mechanism 20 is further comprised of a male swivel 22 and a female swivel 24 and a pin 26 for joining male and female swivels 22, 24.

Turning to FIG. 2, female swivel 24 is axially slotted at its proximal end 30 wherein slot 31 is defined by first and second flanges 32, 34 extending parallel with the axis of female swivel 24. At the base edge 33 of slot 31, a first bore 36 extends concentrically into female swivel 24. First and second flanges 32, 34 are further provided with first and second apertures 38, 40 which extend radially therethrough wherein first and second apertures 38, 40 are in axial alignment with each other and axially perpendicular to the axis of female swivel 24. Extending from the distal end 42 of female swivel 24 is attachment shaft 44.

Referring now to FIGS. 3*a* and 3*b*, male swivel 22 is provided with a first bore 46 and a second bore 48 extending from the distal end 50 of male swivel 22 along the axis of male swivel 22. First and second notches 52, 54 define the proximal end 56 of male swivel 22. First and second notches 52, 54 each have a first surface 55 and a second surface 53. Slot 62 radially extends between first surfaces 55 of notches 52, 54 such that a cavity 64 is formed at the base of second bore 48. Shaft 66 extends axially from the proximal end 56 of male swivel 22.

Turning now to FIG. 4, it can be seen that spring 68 seats in cavity 64 and that pin 26 rides in first and second apertures 38, 40. First notch 52 and second notch 54 are formed to allow proximal end 56 of male swivel 22 to be positioned in slot 31 between first and second flanges 32, 34 of female swivel 24. When assembled, slot 62 of male swivel 22 is aligned between apertures 38, 40 of female swivel 24. Pin 26 is then seated in apertures 38, 40 such that male swivel 22 can rotate about pin 26. Spring 68 is inserted such that it rides between pin 26 and the base of cavity 64.

Figure 5A:
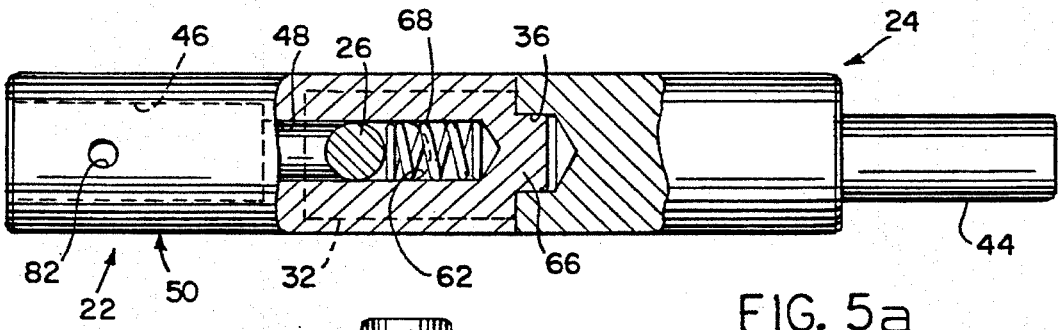
FIG. 5*a* is a side view of the male and female swivels when they are axially aligned, i.e., the mechanism in extended position.
Figure 5B:
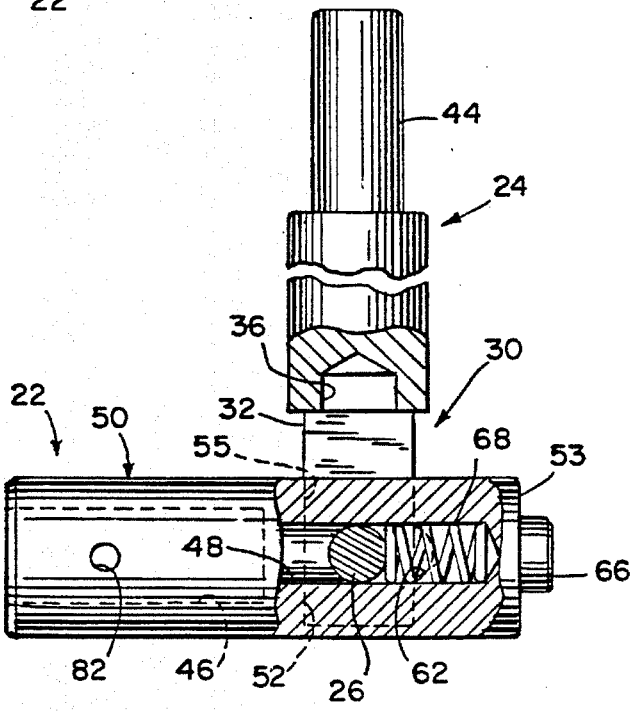
FIG 5*b* is a side view of the male and female swivels when their axes are perpendicular, i.e., the mechanism in retracted position.

Referring to FIGS. 5*a* and 5*b*, as well as the previous FIGS., the relationship between male and female swivels 22, 24 are illustrated in extended and retracted positions. Specifically, FIG. 5*a* depicts male and female swivel 22, 24 when their axes are aligned, i.e., when shaft mechanism 20 is in an extended position. In this position, shaft 66 seats in bore 36. Because spring 68 is constricted by pin 26 and pin 26 is fixed between flanges 32, 34 at the proximal end 30 of female swivel 24, spring 68 urges the proximal end 56 of male swivel 22 away from pin 26, such that the effect of spring 68 is to urge shaft 66 into bore 36. To disengage shaft 66 from bore 36, an opposite force greater than the force exerted by the spring must be applied axially to male swivel 22, until shaft 66 is unseated. With shaft 66 unseated, male swivel 22 may be rotated about pin 26. FIG. 5*b* illustrates the spacial relationship of male and female swivels 22, 24 when shaft mechanism 20 is in a retracted position. In a retracted position, the axis of female swivel 24 is maintained substantially perpendicular to the axis of male swivel 22. Specifically, spring 68 again urges the proximal end 56 of male swivel 22 away from pin 26 such that notches 52, 54 of male swivel 22 abut the sides of flanges 32, 34. Those skilled in the art will understand that the shape of notches 52, 54 and flanges 32, 34 will dictate the relationship between the axes of the male and female swivels. In the preferred embodiment, the shape of notches 52, 54 is such that the two surfaces 53, 55 which define each notch intersect perpendicular to one another and are oriented so that surface 53 extends radially from the axis of male swivel 22 and surface 55 extends parallel along the axis of male swivel 22. The result is that male swivel 22 abuts flanges 32, 34 of female swivel 24 such that male swivel 22 is held substantially perpendicular to female swivel 24.

First bore 31 of male swivel 22 and attachment shaft 44 of female swivel 24 may be provided with attachment bores 80, 82 for receiving pins (not shown) to allow attachment to any standard equipment, such as crank handle 10 (FIG. 1). In one embodiment described herein, shaft 44 allows attachment to arm 12 of crank handle 10. However, those skilled in the art will understand that shaft mechanism 20 which is generally comprised of male and female swivels 22, 24 can be used in a variety of linking configurations on a variety of devices and, therefore, shaft mechanism 20 is not intended to be limited to use with crank handles.

Although the invention has been described in considerable detail through the figures and above discussion, many variations and modifications can be made by one skilled in the art without departing from the spirit and scope of the invention as described in the following claims.

In addition, although the preferred embodiment describes handle 14 as being elongated, any type of structure can be used to grip and transfer force to crank handle 10. For example, a ball or knob grip 14' can replace the elongated grip described above.

What is claimed is:

1. A locking, retracting shaft mechanism, comprising:

a) a female member having proximal and distal ends, wherein said female member is defined by at least two oppositely opposed flanges extending from the proximal end, and an axially aligned bore at the proximal end, the bore extending towards the distal end of said female member;

b) a male member having proximal and distal ends, wherein said male member is defined by at least two oppositely opposed notches at its proximal end, a shaft axially extending from the proximal end of said male member, at least one axial bore extending from said distal end toward said proximal end, and a through slot between adjacent surfaces of the at least two oppositely opposed notches, such that the slot intersects the at least one bore to define a recess within the distal end of said male member;

c) a pin joining said male and female members, wherein said male member is positioned relative to said female member such that the notches of said male member are disposed between the flanges of said female member and said pin extends between the oppositely opposed flanges of said female member and through the slot of said male member; and;

d) a spring disposed in the recess of said male member such that said spring is tensioned adjacent said pin.

2. A locking, retracting crank comprising:

a) an arm, having a proximal end and a distal end;

b) a shaft mechanism attached to the proximal end of said arm, said shaft mechanism further comprising:

1) a female member having a proximal and distal end, wherein said female member is defined by at least two oppositely opposed flanges extending from the proximal end, and an axially aligned bore at the base of the flanges, the bore extending towards the distal end of said female member;

2) a male member having a proximal and distal end, wherein said male member is defined by at least two oppositely opposed notches at its proximal end, a shaft axially extending from the proximal end of said male member, at least one axial bore extending from said distal end toward said proximal end, and a through slot between adjacent surfaces of the at least two oppositely opposed notches, such that the slot intersects the at least one bore to define a recess within the distal end of said male member;

3) a pin joining said male and female members, wherein said male member is positioned relative to said female member such that the notches of said male member are disposed between the flanges of said female member and said pin extends between the oppositely opposed flanges of said female member and through the slot of said male member; and 4) a spring disposed in the recess of said male member such that said spring is tensioned adjacent said pin; and c) a member attached to the distal end of said arm for manipulation in order to apply a force to said shaft.

3. The locking, retracting crank of claim 2 wherein said means for grasping attached to the distal end of said arm is a handle.

4. The locking, retracting crank of claim 2 wherein said means for grasping attached to the distal end of said arm is a knob.

* * * * *

UNITED STATES PATENT AND TRADEMARK OFFICE

CERTIFICATE OF CORRECTION

PATENT NO. : 5,513,544

DATED : May 7, 1996

INVENTOR(S) : John Winkler; John M. Winkler

It is certified that error appears in the above-indentified patent and that said Letters Patent is hereby corrected as shown below:

In Col. 3, line 5, "1" should be --1a-- and Col. 3, after line 6, should be inserted as a new paragraph -- FIG. 1b is a cut-away, side view of a knob to be attached to a locking, retractable crank. --. In Col. 3, lines 29 and 36 and Col. 4, line 14, reference numeral -- 21 -- should be inserted after "axis". In Col. 3, line 40, and in Col. 4, lines 15, 25 and 26, reference numeral -- 23 -- should follow "axis". In Col. 4, lines 1 and 21, reference numerals -- 21, 23 -- should follow "axes".

The paragraph in Col. 4, lines 46-51 should be inserted before the previous paragraph.

Signed and Sealed this

Tenth Day of September, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,513,544

DATED : May 7, 1996

INVENTOR(S) : John Winkler, et. al.

It is certified that error appears in the above-indentified patent and that said Letters Patent is hereby corrected as shown below:

In Col. 5, lines 1 and 10, and in Col. 6, lines 5 and 14, the term "recess" should be -- cavity -- and in Col. 5, lines 19 and 20, the expression "base of the flanges" should be -- proximal end --.

Signed and Sealed this

Sixth Day of May, 1997

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,513,544

DATED : May 7, 1996

INVENTOR(S) : John Winkler; John M. Winkler

It is certified that error appears in the above-identified patent and that said Letters Patent is hereby corrected as shown below:

On the face of the patent in the designation of the Assignee, an assignment was never filed and therefore an Assignee name should not be listed.

Signed and Sealed this

Nineteenth Day of May, 1998

Bruce Lehman

*Attest:*

BRUCE LEHMAN

*Attesting Officer*

*Commissioner of Patents and Trademarks*